US007766054B2

(12) United States Patent
Scott

(10) Patent No.: US 7,766,054 B2
(45) Date of Patent: Aug. 3, 2010

(54) DIMENSIONALLY STABLE FABRIC

(75) Inventor: Donald E. Scott, Taupo (NZ)

(73) Assignee: Aviortex, LLC, Alton, IL (US)

( * ) Notice: Subject to any disclaimer, the term of this patent is extended or adjusted under 35 U.S.C. 154(b) by 273 days.

(21) Appl. No.: 10/584,818

(22) PCT Filed: Dec. 29, 2004

(86) PCT No.: PCT/US2004/043915

§ 371 (c)(1),
(2), (4) Date: Apr. 26, 2007

(87) PCT Pub. No.: WO2005/065369

PCT Pub. Date: Jul. 21, 2005

(65) Prior Publication Data

US 2007/0214843 A1 Sep. 20, 2007

(51) Int. Cl.
*D03D 15/12* (2006.01)
*D03D 1/00* (2006.01)

(52) U.S. Cl. ..... 139/420 R; 139/420 A; 139/383 R

(58) Field of Classification Search ..... None
See application file for complete search history.

(56) References Cited

U.S. PATENT DOCUMENTS

| | | | | | |
|---|---|---|---|---|---|
| 3,115,693 | A * | 12/1963 | Chandler | ..... | 156/148 |
| 4,121,902 | A * | 10/1978 | Guise | ..... | 8/127.6 |
| 5,284,697 | A * | 2/1994 | Sorathia et al. | ..... | 428/213 |
| 5,582,912 | A * | 12/1996 | McCullough et al. | ..... | 428/367 |
| 6,342,280 | B1 * | 1/2002 | Patrick et al. | ..... | 428/34.6 |

* cited by examiner

*Primary Examiner*—Bobby H Huromoto, Jr.
(74) *Attorney, Agent, or Firm*—Chase Law Firm, L.C.

(57) ABSTRACT

A method of producing a dimensionally stable, fire-resistant fabric including the steps of spinning yarn from wool and fire-resistant synthetic fibers, weaving the yarn to form a fabric, and dimensionally stabilizing the fabric to produce a textile that passes aircraft manufacturer specifications.

34 Claims, No Drawings

DIMENSIONALLY STABLE FABRIC

FIELD OF THE INVENTION

This invention relates to wool-synthetic blend fabrics and more particularly to flame-resistant, dimensionally stable wool-synthetic blend fabrics suitable for use in aircraft and other transport interiors.

BACKGROUND OF THE INVENTION

Upholstery fabrics made from wool are known to have an attractive appearance and feel to the touch. Due to the tendency of wool to shrink after washing in water, however, attempts have been made to substitute wool fabrics with fabrics made from synthetic materials such as polyester. The appearance and feel of fabrics made from synthetic materials, however, has been found to be inferior to that of fabrics made from wool. Fabrics made from blends of wool fibers with certain synthetic fibers retain some of the aesthetic features of wool as well as some of the cost benefits and potential property advantages of synthetics.

In the aircraft industry, seat cover fabrics are subject to specifications provided by aircraft manufacturers such as Airbus and Boeing. The relevant Airbus technical specification, for example, is TL 25/5092/83. The relevant flammability, smoke and toxicity portions of the standard are FAR 25.853 (b), appendix F, amended 32, JAR 25853 (b), appendix change 10, and ABD 0031 (previously numbered ATS 1000.001). These specifications include standards for abrasion resistance including resistance to abrasion simulated by a Martindale tester. Resistance to stains resulting from spills, and to loss of color and shrinkage due to washing, is also specified. Seat cover fabrics may be required to meet specifications after a minimum of 10 washings. An areal weight below 470 g/m$^2$ is specified. It is desirable that shrinkage during service life, including shrinkage due to cleaning processes, be minimized. Resistance to pilling, corrosion and color loss may also be specified.

The relevant Boeing specification is BMS 8-236, for general upholstery interior applications. The flammability standard is provided by BSS7230, a twelve second vertical burn test, in which the sample is required to self extinguish within fifteen seconds, with a burn length of less than eight inches. Drips, if any, are required to extinguish in less than five seconds. Smoke emissions of less than 200 are specified according to BSS7238. Prescribed limits for individual toxic components in toxic gas emissions are tested according to BSS 7239. Dimensional stability is evaluated after prescribed cleaning, whether dry cleaning or water washing methods are used. While zero shrinkage is ideal, shrinkage levels of less than 6%, in both warp and fill directions, are acceptable. Standards for appearance, snag resistance, pilling resistance, color fastness and strength are part of the overall specification.

Wool fabrics are typically cleaned using a dry-cleaning process, including immersion in a solvent such as perchloroethylene, in order to maintain the dimensional stability of the fabric. Due to environmental and cost considerations, it would be desirable to clean wool-based fabrics without the use of perchloroethylene or other organic solvents. Water containing surfactants or detergents is highly effective in cleaning such fabrics, however, use of water-based cleaning solutions has been limited by the tendency of wool based fabrics to shrink after being subjected to such solutions. Synthetic fibers, on the other hand, are typically highly resistant to shrinkage following washing in water. Synthetic fibers, however, tend to be highly flammable.

Because of the nature of the constituent parts of the above mentioned wool-synthetic blends, such blends in the prior art are typically neither flame resistant, nor shrink resistant when washed in water. There is a need for fabrics made from wool-synthetic blends that will meet the special requirements for aircraft interiors.

BRIEF DESCRIPTION OF THE INVENTION

In one embodiment of the invention, a method of producing a dimensionally stable, fire-resistant fabric suitable for use on aircraft includes the steps of providing a yarn having a blend of wool fibers and fire-resistant synthetic fibers, the wool fibers comprising approximately 30% to 70% of the blend, weaving the yarn to form a fabric, and dimensionally stabilizing the fabric to achieve a washable woven structure resistant to shrinkage. The synthetic fibers may include polyester fibers produced or treated to enhance fire resistance. The fabric may be dimensionally stabilized by heat setting or by applying a coating such as neoprene or polyurethane.

In another embodiment a method is provided for producing a dimensionally stable, fire-resistant fabric by spinning wool and fire-resistant polyester fibers to form a yarn, weaving the yarn to a form a fabric, and heat-setting the fabric to produce a finished material that passes Airbus and/or Boeing specifications.

In a further embodiment a method is provided for producing a fire-resistant wool-based yarn by spinning shortened wool fibers with fire-resistant polyester fibers in a vortex spinning apparatus. The yarn is woven into a fabric that passes aircraft manufacturer specifications. The fabric is stabilized dimensionally, to prevent or substantially reduce shrinkage during use, by heat-setting the fabric in a stenter apparatus or by applying a coating such as neoprene or polyurethane. In one embodiment, the fabric is dimensionally stabilized such that it resists shrinkage after water washing. In a further embodiment, the method includes treating the yarn or fabric with zirconium to augment the fire-resistant properties.

In yet another embodiment a method is provided for producing a dimensionally stable fabric by providing wool fibers, an effective percentage thereof cut or broken to fall within a selected length range, providing fire-resistant synthetic fibers, spinning the wool and synthetic fibers to produce a wool-synthetic blend yarn, wherein the wool fibers comprise approximately 30% to 70% of the blend, weaving the yarn to form a fabric, and providing dimensional stabilization by application of a polymer coating or by heat setting the fabric to produce a final product that passes aircraft manufacturer specifications.

Wool fibers having a typical length of no greater than approximately five centimeters may be prepared by stretch-breaking. The synthetic fibers may include polyester fibers. Fibers may be spun by delivering the fibers to a ring spinning, air-jet spinning or vortex spinning apparatus for spinning the fibers into a yarn. The fabric may be heat-set by securing and heating the fabric within a stenter. When passing the fabric through a stenter, sufficient heat is applied to set the fabric and produce a dimensionally stabilized fabric resistant to shrinkage. Further steps may include applying zirconium fire retardant to the fabric and applying a coating to bind the zirconium fire retardant to the fabric.

DETAILED DESCRIPTION

In one embodiment, wool fibers are first prepared by reducing their length. Wool tops, consisting of fibers that are approximately 5.5 to 8 cm in length, are passed through a stretch-breaking machine to reduce their lengths to approximately 2 to 5 cm. It is advantageous if the fibers are approximately 3 to 4 cm in length. It is advantageous if the wool fibers have diameters in the range of 13 to 25 microns, and particularly advantageous if the wool fibers have diameters in the range of approximately 22 to 25 microns.

After stretch breaking, the wool fibers are combined with flame retardant (FR) synthetic fibers (such as polyester) having a length of approximately 2 to 5 cm and a compatible denier such as 1 to 4.5, and the resulting combined fiber bundles are passed through one or more draw frames. The drafted wool and FR fiber bundles are introduced into a spinning machine at such relative rates as to achieve wool contents in the range of approximately 30 to 70 percent. It is advantageous to the properties of the resulting fabric if the wool content is in the range of approximately 40 to 60 percent.

Spinning Technology

Typically, carding occurs prior to, or as an initial step in, the spinning process. Through carding, fibers are straightened and made relatively parallel to one another. After carding the fibers form a thin layer called a web. The web is gathered into a loose rope called a sliver. The sliver is typically wound into a large can and then moved to a draw frame. In the drawing process, multiple cans of sliver are drawn together to form a combined sliver.

Ring spinning is a relatively slow spinning technology that typically yields a high quality yarn. During ring spinning, sliver is fed into the drafting zone of the ring spinning frame. The drafting zone has one roller that turns relatively slowly and feeds the sliver and another roller that turns relatively fast. The faster roller pulls out a few fibers at a time forming a fine stream of fibers that are fed to a rotating spindle inside a ring. As the spindle rotates, it drags a slower moving traveler on the ring. The ring twists the fibers as they are wound onto a bobbin that rides on the spindle. After spinning, the yarn may then be used for weaving, perhaps after being further transferred to other holding structures. Ring spinning has been the preferred method of producing high quality wool yarns that demonstrate superior feel to the touch and abrasion resistance.

The air-jet spinning method uses air currents to twist fibers together, resulting in higher throughput and productivity than ring spinning. Air-jet spinning may be used to spin blends of wool and synthetic FR fibers, but yields yarns with reduced abrasion resistance in comparison with ring and vortex spinning.

The air vortex spinning method is a particularly efficient spinning method that is a capable of spinning yarns at very high speeds and that yields a yarn having a relatively smooth texture and increased abrasion resistance. A vortex spinning apparatus typically takes drawn sliver and drafts it to the desired yarn count via a four-roller drafting unit. The drafted fibers are then sucked into a nozzle where a high speed air vortex wraps the fibers around the outside of a hollow stationary spindle. Yarn twist is then imparted as the fibers are pulled down a shaft that runs through the middle of the spindle.

An example of a vortex spinning apparatus is described in the patent to Mori, U.S. Pat. No. 6,370,858, hereby incorporated by reference. Mori discloses a Murata vortex spinning method in which a drafted fiber bundle is supplied to a nozzle block and then to a hollow guide shaft. A core fiber is also fed to the nozzle block and then to the hollow guide shaft. Vortex air currents ejected from spinning nozzles in the nozzle block cause inversely turned fibers to wrap the fiber bundle and core fiber to create core yarn. The core fiber may be multi-filament in which case the vortex air currents balloon the multiple filaments, resulting in the filaments being partially separated from one another. The vortex air currents insert the front ends of the fibers into the clearances between the separated filaments, and cause the other ends of the fibers to wrap around the multi-filament core fiber, resulting in the creation of the core yarn.

In another embodiment, the fiber bundle, comprising a blend of shortened wool and synthetic fibers, is delivered to the vortex spinner and spun without use of core fiber. In this embodiment, vortex nozzle apertures and build pressures are optimized for spinning such that a percentage of the fibers delivered to the spinner tend to form a core. Remaining fibers are simultaneously spun or wrapped around this core thereby causing the core of the yarn to build as the yarn strand itself is formed.

The spinning speed of a vortex spinner is much faster than that provided by ring spinning with the ring method typically producing yarn at the rate of 20 meters per minute and the vortex method typically producing yarn at the rate of 400 meters per minute. The vortex method does not readily accommodate the longer fibers typically used in wool spinning, however, and it has been found to be advantageous to reduce the fiber lengths as illustrated in the various embodiments of the invention disclosed herein.

Preparation of the Fabric

In the various embodiments contained herein, the spinning process used to produce the yarn may include ring spinning, air-jet spinning, air vortex spinning or other appropriate means. It is advantageous, however, to spin the yarn using a vortex spinning method and apparatus.

After spinning, the yarn is typically dyed to a selected color and then woven into a fabric. The particular weave is typically determined by the requirements of the eventual use of the fabric. Appropriate weaves include those known for use by American Airlines and United Airlines.

After weaving, the fabric is heat-set to increase dimensional stability of the fabric. It is advantageous if the heat setting includes the step of affixing the fabric within a stenter frame so that a given dimension may be controlled during the heat-setting process. The fabric is heat set within the stenter by heating the fabric to a temperature in excess of 100° C. The actual temperature used is primarily dependent upon the chemical nature of the synthetic fiber being used. Multiple heating bays may be used, each successive bay typically providing increased heat. In the case where a polyester fiber is used, the maximum temperature is typically set between approximately 170° C. and 220° C. Dwell time, the time period in which heat is applied to the fabric in the stenter may be adjusted according to temperatures used and composition of the fabric. The fabric is typically heated by provision of dry heat using appropriate means such as a gas fired burner and heat exchanger. In one embodiment, dimensional stability results from incipient melting of polyester (or other synthetic) fibers and subsequent bonding of the fibers to form a continuous or semi-continuous polyester network or lattice within the fabric.

In an embodiment directed to vortex spun yarn, wool tops are passed through a stretch-breaking apparatus and the fiber length is thereby reduced to approximately 3 to 4 cm. The wool fibers are then combined with synthetic FR staple (such as polyester) having an approximate length of 3 cm, at a ratio of one part wool fiber to one part synthetic FR fiber, to form an intimate blend. The combined fibers ("intimate blend") are drafted on a drawframe and then spun in a vortex spinner.

Portions of the yarn are dyed to a desired color or colors and then woven into a fabric suitable for use in aircraft such as for seat upholstery. The fabric is heat set in a stenter at an appropriate temperature (approximately 190° C. if the synthetic primarily comprises polyester) for approximately 30 seconds. As a result of this process the fabric meets airline interior fabric test specifications, including those for fire resistance, abrasion and shrinkage after water washing. By way of example, a fabric may be produced in accordance with the above embodiment to pass Airbus specification TL 25/5092/83 and Boeing specification BMS 8-236. Fabric meeting these specifications may be produced without heat setting if the fabric is to be dry-cleaned rather than subjected to water washing.

Representative passing test results include the following for flame resistance, abrasion resistance and relaxation and felting shrinkage (dimensional stability).

TABLE 1

Flame Resistance
(Federal Aviation Regulation § 25.853(a))

| Specimen | Average Burn Time After Flame (seconds) | Average Burn Length (mm) | Average Dripping Flame Time (seconds) |
|---|---|---|---|
| Warp | 8.7 | 83 | Nil |
| Weft | 7.3 | 77 | Nil |

TABLE 2

Abrasion Resistance
(Martindale Method)

| Total Loading | Average No. Cycles to Mechanical End Point | No. Cycles to Grey Scale 3 Color Change End Point | No. Cycles to Unacceptable Appearance Change End Point |
|---|---|---|---|
| 12 Kpa | 46,500 | Not reached | Not reached |

TABLE 3

Dimensional Stability
(Wool/Polyester, American Airlines Weave,
No. of Cycles: 7A × 1, 5A × 2)

| | Width | Length |
|---|---|---|
| % Relaxation shrinkage | −2.1 | −3.5 |
| % Felting shrinkage | −1.5 | −2.1 |
| % Total shrinkage | −3.6 | −5.5 |
| % Area shrinkage | −3.6 | |

As an alternative to fabric produced from a blend of wool and synthetic FR fiber, yarn may be spun from a blend of wool and non-fire resistant synthetic fiber or from wool alone. Fabric woven from such yarn may then be treated with zirconium fire retardant. Such treatment typically includes a coating to bind the zirconium fire retardant to the fabric. If woven from yarn spun from wool and without the addition of synthetic fibers, fabric would typically not be heat set but would retain dimensional stability during use through dry-cleaning rather than washing with water.

Additionally, yarn spun from a blend of wool and synthetic fibers, the wool fibers comprising between approximately 30 to 70 percent of the blend, may be treated with zirconium-based fire retardants prior to weaving to augment the fire-resistant qualities of the resulting fabric. Zirconium treatment may be applied to any of the fabrics set forth above to enhance fire-resistance.

To resist dislodging of the zirconium fire retardant from the fabric during washing, the fabric may be treated with polyurethane or other appropriate material to coat the zirconium and bind it to the fabric.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. A method of producing a dimensionally stable fabric, said method comprising the steps of:

preparing wool fibers by stretch-breaking an effective percentage thereof to a length no greater than approximately five centimeters, providing a yarn having a blend of said wool fibers and fire-resistant synthetic fibers, the wool fibers comprising approximately 30% to 70% of the blend and having diameters of approximately 13 to 25 microns, weaving the yarn to form a fabric, and stabilizing the fabric dimensions to create a woven structure resistant to shrinkage for use in aircraft and other transport interior applications.

2. The method of claim 1, wherein the step of providing yarn includes providing synthetic fibers that comprise polyester fibers.

3. The method of claim 1, wherein the step of stabilizing comprises heat setting the fabric.

4. The method of claim 1, wherein the step of stabilizing includes the steps of securing the fabric within a stenter and heating the fabric to a temperature within the range of 170 to 220° C. for approximately 30 seconds.

5. The method of claim 1, wherein the step of stabilizing comprises applying a coating to the fabric.

6. The method of claim 1, wherein the step of stabilizing comprises applying a synthetic polymer coating to the fabric.

7. The method of claim 6, wherein said polymer comprises neoprene.

8. The method of claim 6, wherein said polymer comprises polyurethane.

9. A method of producing a dimensionally stable fabric, said method comprising the steps of:

providing wool fibers, an effective percentage thereof within a selected length range, providing fire-resistant synthetic fibers, spinning said fibers to produce a wool-synthetic blend yarn, the wool fibers comprising approximately 30% to 70% of the blend, weaving the yarn to form a fabric, and heat setting the fabric in a stenter.

10. The method of claim 9, wherein the step of spinning includes vortex spinning.

11. A method of producing a dimensionally stable fabric, said method comprising the steps of:

preparing wool fibers by stretch-breaking an effective percentage thereof to a length no greater than approximately five centimeters, providing fire-resistant synthetic fibers, spinning the fibers to produce a yarn having a wool fiber to synthetic fiber ratio in the range of approximately 70:30 to 30:70, weaving the yarn to form a fabric, and dimensionally stabilizing the fabric.

12. The method of claim 11, wherein the spinning step includes delivering the fibers to a ring spinning apparatus for spinning the fibers into a yarn.

13. The method of claim 11, wherein the spinning step includes delivering the fibers to an air-jet spinning apparatus for spinning the fibers into a yarn.

14. The method of claim 11, wherein the spinning step includes delivering the fibers to a vortex spinning apparatus for spinning the fibers into a yarn.

15. The method of claim 11, wherein the step of dimensionally stabilizing includes applying a coating to the fabric thereby producing a dimensionally stabilized fabric resistant to shrinkage.

16. The method of claim 11, wherein the step of dimensionally stabilizing includes applying sufficient heat to the fabric to set the fabric thereby producing a dimensionally stabilized fabric resistant to shrinkage.

17. The method of claim 16, wherein the step of applying sufficient heat includes the steps of securing and heating the fabric within a stenter.

18. The method of claim 11, further including the step of applying zirconium fire retardant to the fabric.

19. The method of claim 18, further including the step of applying a coating to bind the zirconium fire retardant to the fabric.

20. A method of producing a dimensionally stable fabric, said method comprising the steps of:

preparing wool fibers by stretch-breaking an effective percentage thereof to a length no greater than approximately five centimeters, providing fire-resistant synthetic fibers, an effective percentage thereof having a length no greater than approximately five centimeters, vortex spinning the fibers to produce a yarn having a wool fiber to synthetic fiber ratio in the range of approximately 70:30 to 30:70, and weaving the yarn to form a fabric.

21. The method of claim 20, wherein the fabric is heat set to pass Airbus specification TL 25/5092/83.

22. The method of claim 20, wherein the fabric is heat set to pass Boeing specification BMS 8-236.

23. The method of claim 20, further including the step of passing the fabric through a stenter, wherein sufficient heat is applied to set the fabric and produce a dimensionally stabilized fabric resistant to shrinkage.

24. The method of claim 20, further including the step of dimensionally stabilizing the fabric through application of a polymer coating.

25. The method of claim 20, further including the step of applying zirconium fire retardant to the fabric.

26. The method of claim 25, further including the step of applying a coating to bind the zirconium fire retardant to the fabric.

27. A method of producing fabric for aircraft and other transport interiors, said method comprising the steps of:

preparing wool fibers by stretch-breaking an effective percentage thereof to a length no greater than approximately five centimeters, vortex spinning the fibers to product a yarn, and weaving the yarn to form a fabric.

28. The method of claim 27, wherein the fabric is heat set to pass Airbus specification TL 25/5092/83.

29. The method of claim 27, wherein the fabric is heat set to pass Boeing specification BMS 8-236.

30. The method of claim 27, further including the step of applying zirconium fire retardant to the fabric.

31. The method of claim 30, further including the step of applying a coating to bind the zirconium fire retardant to the fabric.

32. The method of claim 27, further comprising the step of stabilizing the fabric dimensions to create a woven structure resistant to shrinkage for use in aircraft and other transport interior applications.

33. The method of claim 32, wherein the step of stabilizing comprises applying a synthetic polymer coating to the fabric.

34. A method of producing a dimensionally stable fabric, said method comprising the steps of:

preparing wool fibers by stretch-breaking an effective percentage thereof to a length no greater than approximately five centimeters, providing a yarn having a blend of fire-resistant synthetic fibers and said wool fibers, the wool fibers comprising approximately 30% to 70% of the blend and having diameters of approximately 13 to 25 microns, weaving the yarn to form a fabric, and stabilizing the fabric dimensions to create a woven structure resistant to shrinkage for use in aircraft and other transport interior applications.

* * * * *